US005327609A

United States Patent [19]

Bierma et al.

[11] Patent Number: 5,327,609

[45] Date of Patent: Jul. 12, 1994

[54] MOPSWEEPING APPARATUS WITH CONTINUOUS ACTION

[75] Inventors: Ulrk F. Bierma, Ijsselstein; Dirk M. Both, Waddinxveen, both of Netherlands

[73] Assignee: Reinhoud B.V., Ijsselstein, Netherlands

[21] Appl. No.: 777,241

[22] PCT Filed: Jan. 24, 1991

[86] PCT No.: PCT/NL91/00010

§ 371 Date: Nov. 25, 1991

§ 102(e) Date: Nov. 25, 1991

[87] PCT Pub. No.: WO91/11134

PCT Pub. Date: Aug. 8, 1991

[30] Foreign Application Priority Data

Jan. 24, 1990 [NL] Netherlands ..... 9000184

[51] Int. Cl.[5] ..... A47L 11/29

[52] U.S. Cl. ..... 15/98; 15/99; 15/228; 15/231

[58] Field of Search ..... 15/98, 99, 228, 231; 118/257

[56] References Cited

U.S. PATENT DOCUMENTS

| | | | |
|---|---|---|---|
| 1,480,285 | 1/1924 | Moore | 15/99 |
| 1,661,510 | 3/1928 | Sproston | 15/98 |
| 1,995,685 | 3/1935 | Perkins | 15/98 |
| 2,330,208 | 9/1943 | Fay | 15/99 |
| 3,150,396 | 9/1964 | Unterbrink | 15/98 |
| 3,150,407 | 9/1964 | Mitchell | 15/98 |
| 3,868,738 | 3/1975 | Horst et al. | 15/98 |
| 4,246,674 | 1/1981 | Ingermann et al. | 15/98 |
| 4,562,610 | 1/1986 | Davis et al. | 15/99 |

*Primary Examiner*—Edward L. Roberts

*Attorney, Agent, or Firm*—Hayes, Soloway, Hennessey, Grossman & Hage

[57] ABSTRACT

Mopsweeping apparatus is disclosed which has a housing adapted to move over a surface to be cleaned. A cooperating pair of rollers is carried by the housing and comprises a first roller having a dust gathering cloth wound thereon and a second roller on which the cloth is windable. A motor is provided to drive the rollers for winding the cloth from the first roller to the second roller, with the winding direction being in the same direction as the direction of movement over the surface. A pressing structure under which the cloth is retained is provided. The pressing structure comprising two rollers over which an endless flexible belt is carried to provide a horizontal contact surface with the surface to be cleaned.

9 Claims, 1 Drawing Sheet

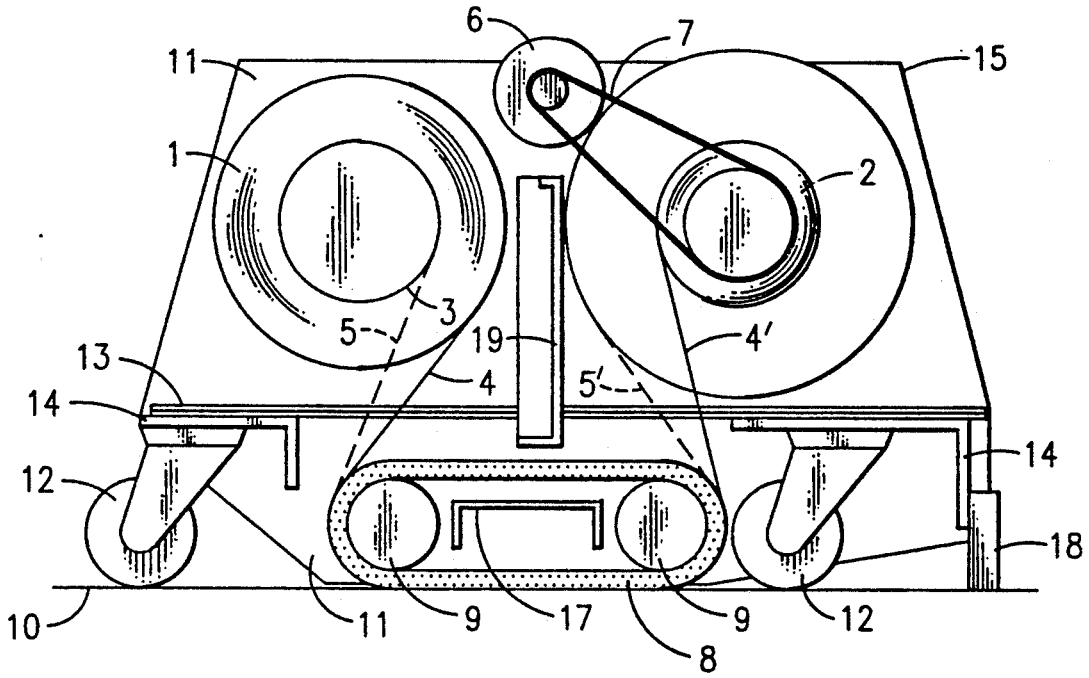
6
7
11
15
1
2
3
5
19
4'
13
4
5'
14
14
12
18
10
11
9
17
9
12
8

MOPSWEEPING APPARATUS WITH CONTINUOUS ACTION

The present invention relates to a mopsweeping apparatus for periodically or daily removal of dust and dirt particles from solid floor coverings, comprising a dust binding cloth which is moved on the floor to be cleaned.

There are several mopsweeping apparatuses known to remove dust from the floor and which contain disposable cloths. If after some time the cloth is saturated with dust and dirt it is exchanged for a clean impregnated cloth. Thus it is necessary in this stepwise system to exchange the cloths after fixed times which is time consuming. Furthermore, the moment of exchange is rather subjective. It is possible that the cloth is used too long a time and thus the desirable degree of cleaning is not obtained.

The invention is now directed to a continuous mopsweeping apparatus wherein the cloth without interaction from outside is continuously renewed and a more regular dust and dirt removal is obtained. In this way the numerous stopping moments needed in the old system to replace the cloth are abandoned.

Thus, the invention provides a mopsweeping apparatus comprising a dirt receiving cloth which is moved over the floor to be cleaned which is characterized in that it comprises a manually or a motor driven movable frame wherein a driven cooperating pair of rollers is present, on the one roller of which a supply of cloth is wound and on the other roller of which the cloth, when driven, is windable and between which a pressing means is provided, under which the cloth is retained during movement on the floor. The roller pair is preferably motor driven and preferably the take-up roller is driven. The driving preferably takes place so that the winding direction of the cloth rubs in the same direction as the movement of the total apparatus in contact with the floor. Preferably the winding velocity of the cloth is substantially lower than the movement velocity of the apparatus, which amounts to about a slow walking velocity of about 3–4 km/hour. A favourable value of the cloth velocity is generally in the range of 2–15 m/hour, with preference for values of 3–10 m/hour especially 3–6 m/hour. By choosing the winding direction and the movement direction in the same sense the backside of the apparatus always contains a clean cloth while the dirty part is present at the frontside. This is favourable for removal of dirt. Further the collection of coarser dirt particles (such as stamps, paper balls, plastic cups, etc.) which assembly at the frontside and could damage the cloth, is facilitated. For this purpose preferably at the frontside a catching means is arranged, for example a strip, bent in a U-form which does not touch the floor, possible with catching arms. During a stop the collected dirt particles can then be removed. The mopsweeping apparatus is transported on wheels, which preferably are adjustable in height, so that the pressure of the cloth on the floor is variable and can be adapted to the type of floor, the cloth used etc. The pressing means should permanently keep the cloth on the floor. For this purpose a stationary bottom plate comprising metal or plastic can be used under which the cloth is guided. However, the pressing means preferably is self-movable in the shape of one or more rolls, under which the cloth is moving and which rolls themselves are rotating. The plate or rolls are further coated with a resilient porous material which can take up the unevenesses in the floor. The pressing means also can exist of an assembly of rolls coated with resilient material which touch the floor.

In a preferable embodiment an endless belt is used which runs over two rollers, which are arranged in a frame and guide the cloth over the floor. In this embodiment more flexible action is ensured while also a favourable working surface of the cloth can be reached coupled with an acceptable breadth. The material from which the belt is composed and which further serves as coating material for the pressing plate or rolls must be inert and resistant to chemicals and oil. For this purpose various technical plastic materials are available, which are also resilient and porous. (As such are also considered foam materials like polyether foam).

The cloth preferably consists of a nonwoven which is preimpregnated with a dust binding agent. In another embodiment a non-preimpregnated nonwoven is provided with a dust binding agent during the use of the apparatus. Commerically available cloths are for instance RBO-THRO and ROVOLIN. The dimensions of the cloth depend on the apparatus used. When using one pressing roller there is a line contact which may be sufficient for lighter activities. The working breadth can vary from 600 mm to 1.50 m the lower values being favourable for manual driving. The length of the cloth is not critical and depends on the size of the rollers used. Generally, sufficient material is provided to enable use during a long time. In practice an amount of about 50 m is found favourable. With such an amount an action of five to size hours at a velocity of 9 m/hour of the cloth especially about 10 hours at a velocity of about 5 m/hour is ensured.

The whole apparatus can be moved by mounting it on an electrically driven scooter. Thus the user can, sitting on the scooter, drive it and thus treat the floor to be cleaned. One can also use human power in which case a battery is mounted on the apparatus which provides current to the motor of the winding roller. In the scooter version the battery of the scooter serves this purpose.

The motor can be provided with a switch for stepwise actuation, possibly by means of a timing switch.

It is to be understood that, owing to the different velocities of the winding of the cloth and the moving velocity of the apparatus, a slip arises between the cloth and the floor, which of course is favourable for the cleaning power. The number of rotations of the motor can be adjustable, so that one may choose the right velocity dependant on the circumstances and that this during action possibly can be changed.

The foregoing description relates to the dry cleaning of floors. It is also possible to carry out a wet cleaning by starting from a hydrofylic nonwoven or woven cloth which may be impregnated with a cleaning agent. The cloth used should then be a moisture and water receiving cloth, which may be impregnated with a floor cleaning agent and/or floor maintaining agent which is known, and which mostly is made somewhat thicker.

If necessary, a water tank can be mounted to the mopsweeping apparatus, which is in communication with the pressing means and delivers (additional) water during the mopping action. Preferably one starts from a dry cloth impregnated with the cleaning agent and/or the maintenance product, the water necessary being dosed from a water tank. Possibly the water tank may contain a (additional) floor cleaning agent and/or a floor maintaining agent, the moistening of the cloth taking place before or during the pressing step.

The pressing means can be made adjustable to select the pressure on the floor. However, this can also be reached by making adjustable the wheels of the apparatus, which has preference. The pivoting wheels are mounted on an angle line belonging to the frame which has a small angle deviation relative to the floor. During the forward movement of the apparatus, the cloth will thus be brought in contact with the floor by the pressing means, while during a backwards movement the whole apparatus is tilted several millimeters from the floor. The cloth then comes free from the floor.

The apparatus will now be illustrated by means of the added FIGURE, which is a schematic evaluation of the apparatus according to the invention. In this FIGURE a preferred embodiment is indicated wherein use is made of an endless belt running over two rollers.

FIG. 1 shows the roller 1 with a clean cloth and the winder roller 2. The cloth 3 is running from roller 1 to roller 2. The dotted lines 5 and 5' as well as solid lines 4 and 4' indicate the course of the cloth, i.e., of a roller just provided with cloth (4, 4') and of a practically empty roller (5, 5') with respectively an empty and a full winding roller (4', 5') Winding roller 2 is driven by motor 6 through drive 7. Between both rollers is the endless belt 8 of porous resilient material, running about the two rollers 9. This belt is in the frame 11 of the apparatus and touches the floor 10 with a light pressure; the cloth is running between the floor 10 and the endless belt 8; the rollers 9 are not driven.

The apparatus is further provided with a house or a cap 15. To the frame 11 wheels 12 are connected. A hinge 13 is provided with which the house can be opened for replacement of the rollers. In the centre 17 and 19 indicated connection means, whereas 14 also indicates connection means. In use, after roller 1 is provided with a clean cloth and this is fixed to the take-up roller by means of the underside of the endless belt 8, the motor is started, which drives the take-up roller through the driving belt 7 with adjustable velocity. The apparatus is then moved over the floor either manually or with the use of a scooter. During action the coarser dirt assembles at the frontside of the apparatus, where a preferably U-shaped strip 18 is placed, which retains this dirt; this strip can possibly be replaced by a rubber strip.

After the nonwoven cloth is completely unwound from roller 1 onto roller 2 the rollers are removed and replaced by new ones. By means of the different setting possibilities the apparatus can be adapted to the current circumstances and the type of floor in such a way that the best results are obtained.

We claim:

1. Mopsweeping apparatus comprising a housing adapted to be moved over a surface to be cleaned, a cooperating roller pair, carried by said housing, and comprising a first roller and a second roller, a supply of a dust gathering cloth wound on said first roller, said cloth being windable from said first roller to said second roller, means for driving said cooperating roller pair for winding said cloth from said first roller to said second roller, the winding direction of said cloth being in the same direction as the movement of said apparatus over said surface to be cleaned, and a pressing means under which said cloth is retained during movement of said apparatus over a surface to be cleaned, said pressing means comprising two rollers over which an endless flexible belt is carried, said pressing means providing a horizontal contact surface with said surface to be cleaned.

2. Mopsweeping apparatus according to claim 1, wherein the cloth is wound at a velocity which is considerably lower than the moving velocity of the apparatus.

3. Mopsweeping apparatus according to claim 2, characterized in that the winding velocity is 2–15 m/hour at a moving velocity of about 3–4 km/hour.

4. Mopsweeping apparatus according to claim 1, wherein the belt consists of an inert, resilient plastic material which is porous and which can take up the unevennesses of the floor and which is further resistant to chemicals and oil.

5. Mopsweeping apparatus according to claim 1, wherein said cloth is impregnated with a dust binding agent.

6. Mopsweeping apparatus according to claim 1, wherein the cloth is moisture or water absorbent.

7. Mopsweeping apparatus according to claim 6, wherein the cloth is impregnated with a floor cleaning agent and/or a floor maintaining agent.

8. Mopsweeping apparatus according to claim 1, wherein said housing is manually driven.

9. Mopsweeping apparatus according to claim 1, further comprising a means located adjacent the front of said apparatus in close proximity to said surface to be cleaned, for retaining coarse dirt particles.

* * * * *